US009140018B2

(12) United States Patent
Southwell

(10) Patent No.: US 9,140,018 B2
(45) Date of Patent: Sep. 22, 2015

(54) CLADDING ELEMENT

(71) Applicant: JAMES HARDIE TECHNOLOGY LIMITED, Dublin (IE)

(72) Inventor: Darren Southwell, Rosehill (AU)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 14/359,908

(22) PCT Filed: Nov. 21, 2012

(86) PCT No.: PCT/EP2012/073282

§ 371 (c)(1),
(2) Date: May 21, 2014

(87) PCT Pub. No.: WO2013/076172

PCT Pub. Date: May 30, 2013

(65) Prior Publication Data

US 2014/0345226 A1 Nov. 27, 2014

(30) Foreign Application Priority Data

Nov. 22, 2011 (GB) ..... 1120097.9

(51) Int. Cl.
*E04B 2/00* (2006.01)
*E04B 5/00* (2006.01)
(Continued)

(52) U.S. Cl.
CPC ..... *E04F 13/076* (2013.01); *E04F 13/0817* (2013.01); *E04F 13/0864* (2013.01); *E04F 13/0894* (2013.01); *E04F 13/16* (2013.01); *E04F 13/0801* (2013.01); *E04F 2201/0107* (2013.01)

(58) Field of Classification Search
CPC . E04F 13/0864; E04F 13/076; E04F 13/0894; E04F 19/022; E04F 13/0801
USPC ..... 52/506.1, 782.1, 551, 506.06, 509, 510, 52/511, 519, 489.2, 588.1, 539, 409, 478, 52/536
See application file for complete search history.

(56) References Cited

U.S. PATENT DOCUMENTS 525,442 A * 9/1894 Burrows ..... 52/539
4,825,618 A * 5/1989 Blevins ..... 52/592.5
(Continued)

FOREIGN PATENT DOCUMENTS

EP 1 557 507 A2 7/2005
FR 2 649 739 A1 1/1991
(Continued)

OTHER PUBLICATIONS

International Search Report and Written Opinion for corresponding PCT Application No. PCT/EP2012/073282, filed Nov. 21, 2012, dated Apr. 15, 2013, 14 pages.
(Continued)

*Primary Examiner* — Chi Q Nguyen
(74) *Attorney, Agent, or Firm* — Knobbe, Martens, Olson & Bear, LLP

(57) ABSTRACT

A cladding element (100), for use in a building envelope, comprising a first face (101), a second face (102) and a peripheral edge member, the first face and second face being spaced apart to define an intermediate portion of predetermined thickness (t), the peripheral edge member extending around the intermediate portion. The first face (101) comprises a profiled portion (106) simulating a masonry weather joint aesthetic thereby minimizing dirt and debris accumulation on the profiled portion of each cladding element in a constructed wall section. In addition the profiled portion provides a self-cleaning functionality. The profiled portion also provides an improved shadow zone contrast when arranged in a building array.

12 Claims, 6 Drawing Sheets

(51) Int. Cl.

| | |
|---|---|
| ***E04B 9/00*** | (2006.01) |
| ***E04F 13/076*** | (2006.01) |
| ***E04F 13/16*** | (2006.01) |
| *E04F 13/08* | (2006.01) |

(56) References Cited

U.S. PATENT DOCUMENTS

| | | | | |
|---|---|---|---|---|
| 5,016,416 | A * | 5/1991 | Munk | 52/539 |
| 8,381,475 | B2 * | 2/2013 | Carbines | 52/546 |
| 8,397,459 | B2 * | 3/2013 | Gately | 52/539 |
| 8,484,931 | B2 * | 7/2013 | Gleeson et al. | 52/747.1 |
| 8,621,812 | B2 * | 1/2014 | Holt | 52/509 |
| 8,689,509 | B2 * | 4/2014 | Gleeson et al. | 52/461 |
| 8,863,459 | B2 * | 10/2014 | Holt | 52/509 |
| 2008/0083188 | A1 * | 4/2008 | Swanson | 52/536 |
| 2009/0007516 | A1 * | 1/2009 | Swanson | 52/524 |
| 2010/0263316 | A1 * | 10/2010 | Bruneau | 52/546 |
| 2014/0215945 | A1 * | 8/2014 | Swanson | 52/302.1 |

FOREIGN PATENT DOCUMENTS

| | | | |
|---|---|---|---|
| WO | WO 2008/106735 | A1 | 9/2008 |
| WO | WO 2013/076172 | A1 | 5/2013 |

OTHER PUBLICATIONS

International Preliminary Report on Patentability and Written Opinion for corresponding PCT Application No. PCT/EP2012/073282, filed Nov. 21, 2012, dated Jun. 6, 2014, 7 pages.

* cited by examiner (b)

(a)

(b)

(a)

CLADDING ELEMENT

FIELD OF THE INVENTION

The present invention relates to a building element suitable for use in construction. In particular the present invention relates to a cladding element suitable for use in a building envelope.

The invention has been developed primarily for use as a cladding element and will be described hereinafter with reference to this application. However, it will be appreciated that the invention is not limited to this particular field of use and that the invention can be used in any suitable field of use known to the person skilled in the art.

BACKGROUND OF THE INVENTION

Any discussion of the prior art throughout the specification should in no way be considered as an admission that such prior art is widely known or forms part of the common general knowledge in the field.

Masonry construction is expensive and time consuming and requires a high level of skill to install adequately and provide durable and aesthetically acceptable joint finishing. It is known to use raked mortar joints to maximize durability and minimise water permeation through the mortar into the wall cavity. Raked mortar joints minimise contrast between the joints and the face of the masonry units.

Masonry construction is also known to use flush mortar joints to provide high contrast between the mortar and the masonry units. Flush mortar joints, however, are susceptible to water permeation and are not commonly used.

Weather joints are known in masonry construction to provide increased durability compared to raked or flush mortar joints. Weather joints, however, are generally overshadowed and can't provide maximum contrast between the masonry units and the mortar joints.

However, raked mortar joints allow dirt and debris to accumulate in the joints. Nonetheless, consumers generally like the aesthetic appearance of raked mortar joints over other known types of mortar joints.

Cladding elements such as overlapping planks that include surface profiling are known. Dirt or debris can accumulate in the contours on the face of such profiled planks. Such debris is difficult to remove once accumulated.

Shiplap plank cladding elements are known. Such elements do not need an overlap to provide full wall coverage. Use of a shiplap joint means that planks may be installed so that they sit with the main face of the plank oriented substantially vertically. Although the angle of the face has been increased relative to that of the overlapped plank type, profiling on the surface can provide regions of low angle relative to the horizontal plane that act as dirt, debris and moisture accumulation points. Traditional profiles include curved or contoured surface features intended to mimic classical wood profiles, decorative scrollwork or plaster features. None of these provide a shadow zone or a contrast between a shadow zone and a profiled section.

OBJECT OF THE INVENTION

It is an object of the present invention to overcome or ameliorate at least one of the disadvantages of the prior art, or to provide a useful alternative.

SUMMARY OF THE INVENTION

According to the invention there is provided a cladding element, suitable for use in a building envelope, comprising a first face, a second face and a peripheral edge member, the first face and second face being spaced apart to define an intermediate portion of predetermined thickness, the peripheral edge member extending around the intermediate portion;

the first face further comprising a profiled portion adjacent at least a portion of the peripheral edge member;

the profiled portion of the first face comprising a recessed portion simulating a recessed mortar joint in a constructed wall; a fixing zone intermediate the recessed portion and the at least a portion of the peripheral edge member, and an angled portion intermediate the first face and the recessed portion, whereby the angled portion comprises an acute angle relative to the axes of intersection between the first face and a plane that extends perpendicularly from the first face.

It is to be understood that the first face of the cladding element is the outer face of the cladding element. The outer face is the face of the cladding element normally in view when the cladding element is used as part of a building envelope. The advantage of the present invention is that it provides a cladding element having a profiled portion which simulates a masonry joint whilst also minimising dirt and debris accumulation on the profiled portion of each cladding element. In the preferred embodiment of the invention the profiled portion is shaped to simulate a masonry weather joint. It is of course understood that the profiled portion of the cladding element is not limited to simulate a masonry weather joint and that other types of masonry joints are also possible. The present invention also provides a cladding element comprising an improved shadow zone for contrast detail. A further advantage of the present invention is that the degree by which the angled portion is angled relative to the first face is selected to achieve a self-cleaning functionality whereby the angle is selected to aid removal using natural environmental conditions.

Accordingly, the present invention provides a cladding element suitable for simulating a masonry weather joint aesthetic, providing an improved shadow zone contrast and for minimising dirt and debris accumulation on the profiled portion of each cladding element through a self-cleaning functionality.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term "comprise" is to be attributed with as broad an interpretation as possible within any given jurisdiction and this rationale should also be used when the terms 'comprised' and/or 'comprising' are used.

In one embodiment of the invention the acute angle relative to the axes of intersection between the first face and a plane that extends perpendicularly from the first face defines an angle that is less than 90 degrees relative to two reference axes commonly known as the x- and y-axes. For the purpose of this description it is understood that the plane extending perpendicularly from the first face corresponds to the x-axis. Accordingly, it is understood that the first face corresponds to the y-axis. It is also to be understood that the first face could also correspond to the x-axis. In this circumstance, the plane that extends perpendicularly from the first face then corresponds to the y-axis.

In another embodiment of the invention, the acute angle is between 20 to 75 degrees.

In a further embodiment of the invention, the acute angle is between 30 to 60 degrees.

In a further embodiment of the invention, the acute angle is approximately 45 degrees.

In a further embodiment of the invention the recessed portion comprises a planar section that is substantially parallel to the plane of the first face.

In a further embodiment of the invention the fixing zone comprises a zone that is suitable for providing attaching means for securing the cladding element to a building or frame support when being used as a cladding element in a building envelope. Conveniently, the fixing zone is suitable for concealed fixing of the cladding element.

In a further embodiment on the invention the peripheral edge member comprises at least one profiled side edge. In a further embodiment of the invention, the at least one profiled edge member comprises a first profiled side edge portion and a second profiled side edge portion, whereby each profiled side edge portion comprises a releasably engageable mutually complementary profile. The advantage of such an arrangement is that the first and second profiled edge portion seat together easily to avow for ease of installation of adjacent cladding elements in a vertical array.

In one embodiment of the invention, the releasably engageable complementary profile is a shiplap profile.

In a further embodiment of the invention, the shiplap profile further includes an angled portion for interlocking adjacent cladding elements in a vertical building array.

In a further embodiment of the invention the first face, second face and peripheral edge member are integrally formed as a single unit.

In one embodiment of the invention, the recessed portion includes a nailing zone.

In one embodiment of the invention, the nailing zone is located within the releasably engageable complementary profile.

BRIEF DESCRIPTION OF THE DRAWINGS

The invention will now be described more particularly with reference to the accompanying drawings, which show by way of example only cladding elements of the invention.

In the drawings.

PREFERRED EMBODIMENT OF THE INVENTION

Figure 1:
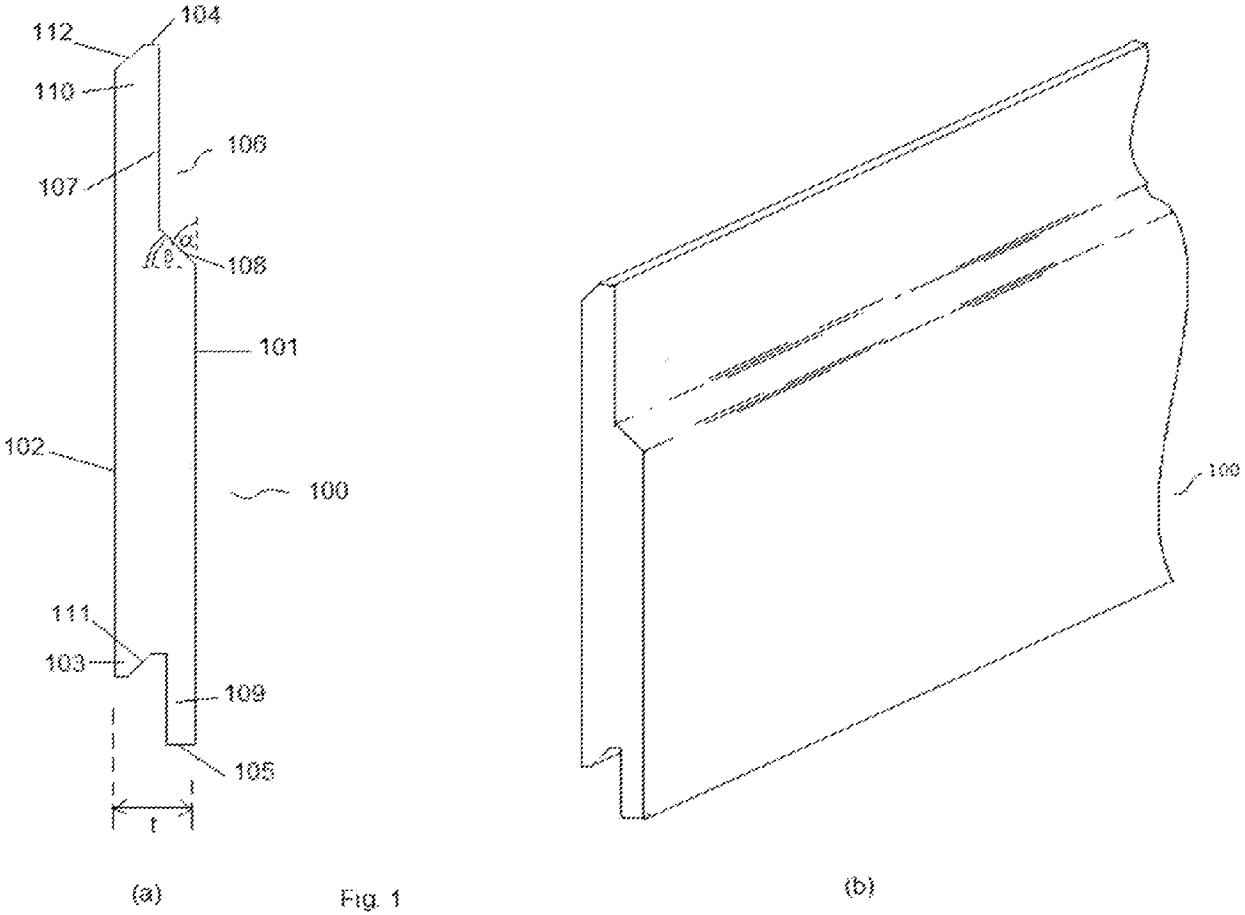
FIG. 1 (a) is a cross-sectional view of a cladding element according to the invention and (b) is a perspective view of the cladding element of FIG. 1 (a)

Although making and using various embodiments are discussed in detail below, it should be appreciated that the invention described provides inventive concepts that may be embodied in a variety of contexts. The embodiments discussed herein are merely illustrative of ways to make and use the described invention and do not limit the scope of the invention.

In the description which follows like parts may be marked throughout the specification and drawing with the same reference numerals, respectively. The drawing figures are not necessarily to scale and certain features may be shown exaggerated in scale or in somewhat generalized or schematic form in the interest of clarity and conciseness.

Unless the context clearly requires otherwise, throughout the description and the claims, the words "inclined surface", "angle of inclination", and the like are to be construed as referring to inclination with respect to the plane that extends perpendicularly from the first face. In the instance where the cladding element is installed in a vertical arrangement, the horizontal plane is the plane that extends perpendicularly from the first face. Accordingly in the following description the terms horizontal plane and the plane that extends perpendicularly from the first face are sometimes used interchangeably.

Referring now to the drawings and initially FIG. 1 (a), there is shown a cross-sectional view of cladding element 100, for use in a wall section construction. Cladding element 100 comprising a first face 101 and second face 102 spaced apart defining predetermined thickness (t). First face 101 comprises a profiled portion 106 adjacent a first profiled side edge 104. Profiled portion 106 comprises a recessed portion 107 and an angled portion 108 transitioning between the first face 101 and recessed portion 107. Angled portion 108 comprises an acute angle $\alpha$ relative to the axes of intersection between the first face 101 and a plane that extends perpendicularly from the first face 101. The axes of intersection are shown in dotted format in FIG. 1 (a) as an artificial extension of a front face 101 at one side of angle $\alpha$ and an artificial line within the intermediate portion of cladding element 100 at one side of angle $\beta$. The artificial line at one side of angle $\alpha$ being at right angles to the artificial line at one side of angle $\beta$.

Figure 4:
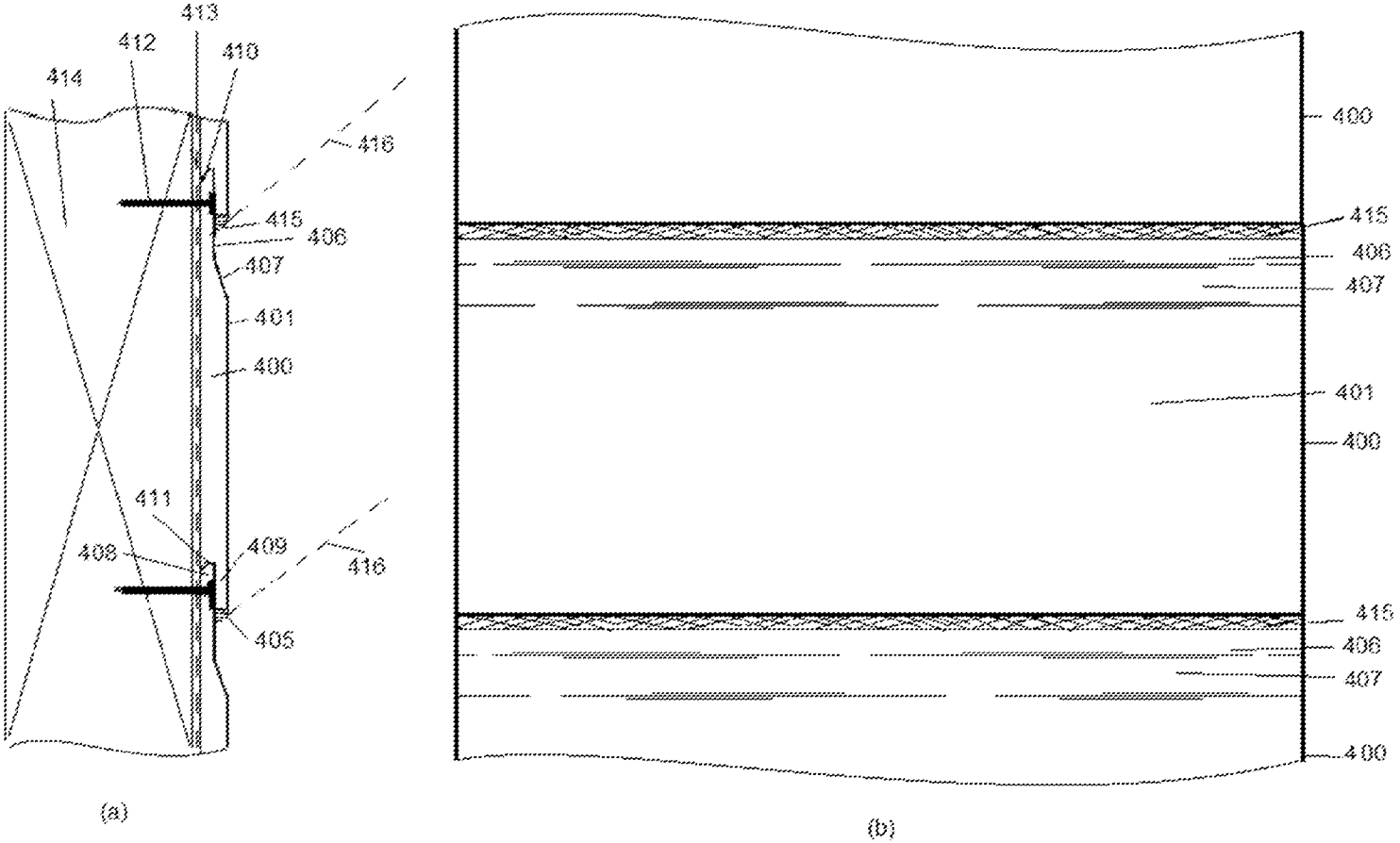
FIG. 4 (a) is a cross-sectional side view, and FIG. 4 (b) is a front view, of a number of cladding elements according to the invention installed in a vertical array in a constructed wall section and showing low incident sun angle shadow zones.
Figure 5:
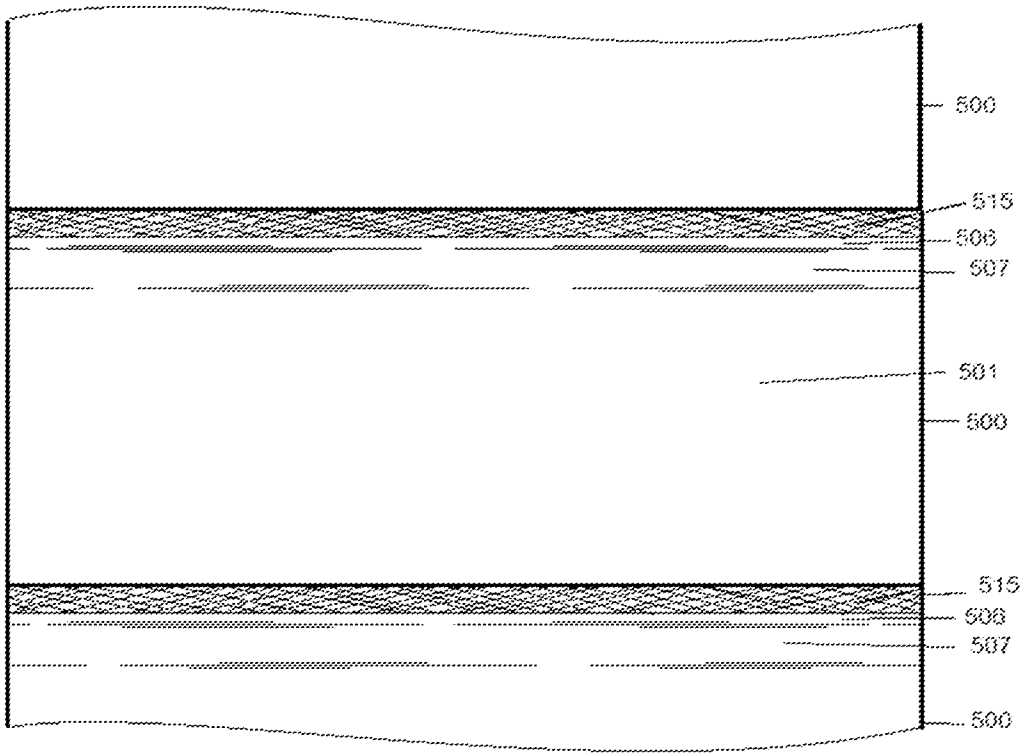
FIG. 5 is a cross-sectional side view, and FIG. 5 (b) is a front view, of a number of cladding elements according to the invention installed in a vertical array in a constructed wall section and showing high incident sun angle shadow zones.
Figure 5:
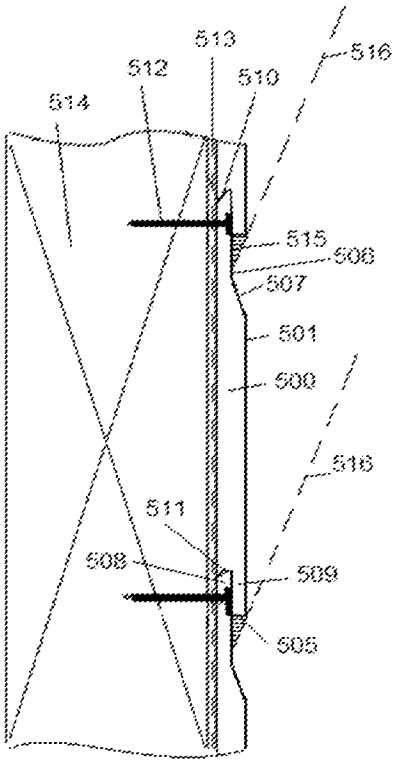
Figure 7:
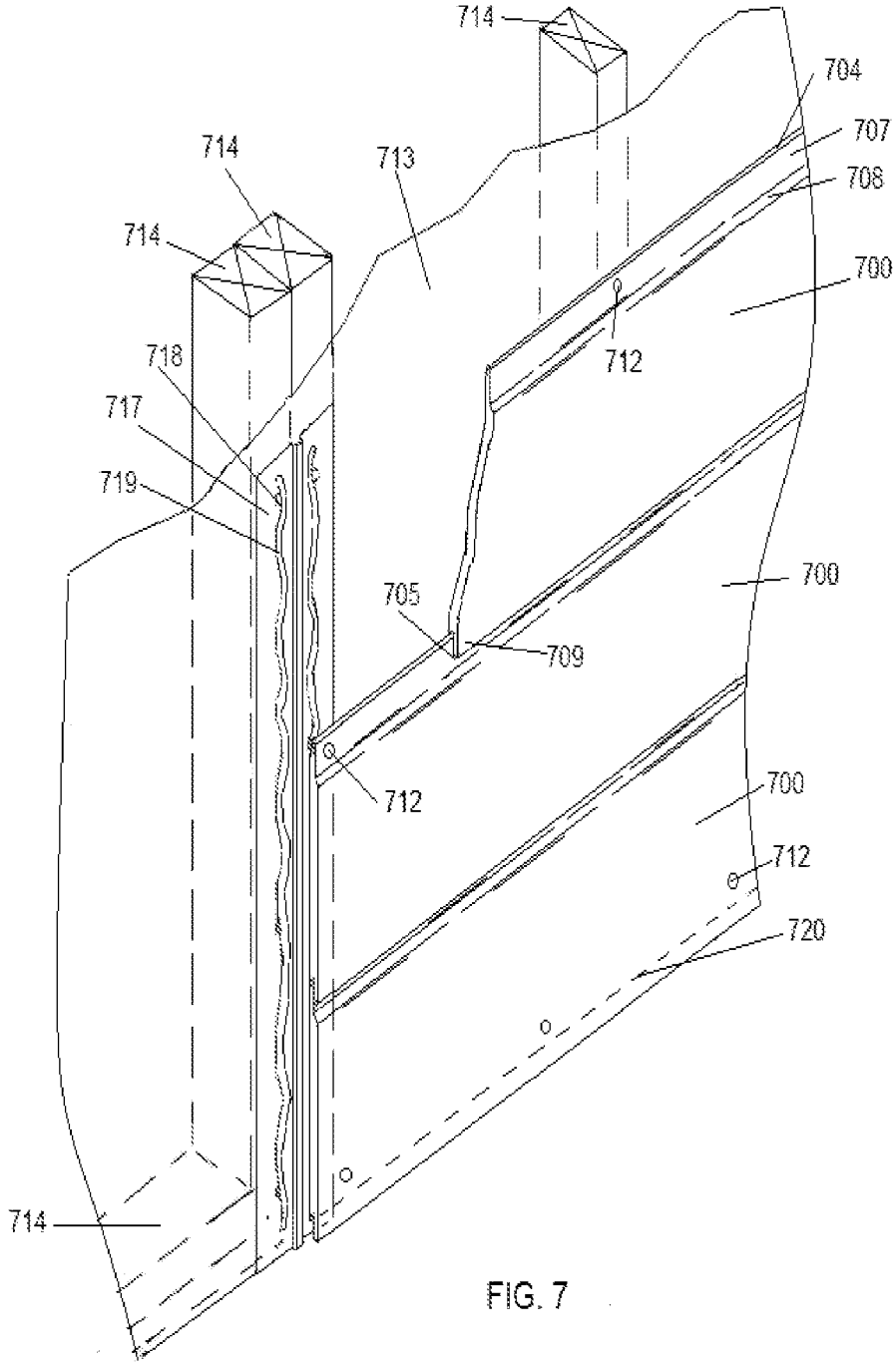
FIG. 7 is a partially cut away perspective view of a number of cladding elements according to the invention being installed on a supporting frame in a vertical array.

Recessed portion 107 is substantially planar and simulates a recessed mortar joint in a constructed wall section. Accordingly, in appearance recessed portion 107 is stepped back from the first face 101 such that recessed portion 107 extends in a plane that is substantially parallel to plane of the first face 101. The angled portion 108 intermediate front face 101 and recessed portion 107 simulates a masonry weatherjoint thereby maximising contrast between the shadow zone provided by shading of recessed portion 107 and an overlap portion 109 of a corresponding cladding element when arranged in a building array as shown in FIGS. 4, 5 and 7. The angled portion 108 simultaneously minimises or substantially eliminates dirt and debris accumulation in profiled portion 106 of a constructed wall section or building array.

In the embodiment shown, the cladding elements 100 are in the form of wide laths. The overall dimensions for this embodiment of the invention are approximately 4 meters long and approximately 300 to 450 mm wide. The overall width of profiled portion 106, including recessed portion 107 and angled portion 108, is approximately 35 mm to 55 mm wide. It is understood that the actual width of the lath is dependent upon angle $\alpha$. Angled portion 108 will contribute approximately 1.5 to 25 mm to the width of the lath depending on angle α. Overlap portion 109 may be approximately 20-30 mm wide, and more conveniently approximately 25 mm wide. A perspective view of cladding element 100 is shown in FIG. 1 (b).

In FIGS. 1 (a) and (b), angle α is within the range of approximately 20 to 75 degrees. In other embodiments of the invention, α is between approximately 30 to 60 degrees. In a further embodiment of the invention α is approximately 45 degrees. Angle β of angled portion 108, is the angle of inclination with respect to the plane that extends perpendicularly from the first face 101. Angle β can be calculated as 90 degrees minus α for a constructed wall section where cladding elements are installed with their lower edge substantially parallel to a horizontal plane. Where angle β is around or slightly above the highest angle of repose for the most common particulate dirt and debris matter likely to be found accumulating on surfaces on a building envelope, then accumulation will be substantially eliminated. Any dirt or debris material will not be able to form a stable pile on the inclined surface and will fall or will be easily washed off that surface and a simple self-cleaning capability will have been established.

The angle of repose of a material is measured from the horizontal plane and expresses the greatest angle a large piled deposit of a material will form before the force of gravity overcomes the combined forces of particle size, shape, density and co-efficient of static friction and the piled deposit collapses. For surfaces inclined with respect to the horizontal, the angle of repose minus the angle of inclination of the surface gives a measure of the maximum angle at which a material can rest on the surface without sliding down/off. If the angle of inclination is higher than the angle of repose of a material, then no accumulation can take place as all material that lands on the surface will slide down the surface, and in this case, off the edge. For example, the angle of repose for dry silica sand is approximately 34 degrees, clay is generally within the range 25-40 degrees, and soil is in the range 30-45 degrees. These are equivalent to α values (90 minus β) of 56 degrees, 65–50 degrees and 45–60 degrees respectively.

Table 1 below provides a range of values for angle of repose for common dirt and debris materials.

TABLE 1

| Material | Angle of Repose |
|---|---|
| Silica sand (dry) | Approx 34 |
| Silica sand (damp) | Approx 45 |
| Clay (dry) | 25-40 |
| Soil | 30-45 |

Figure 6:
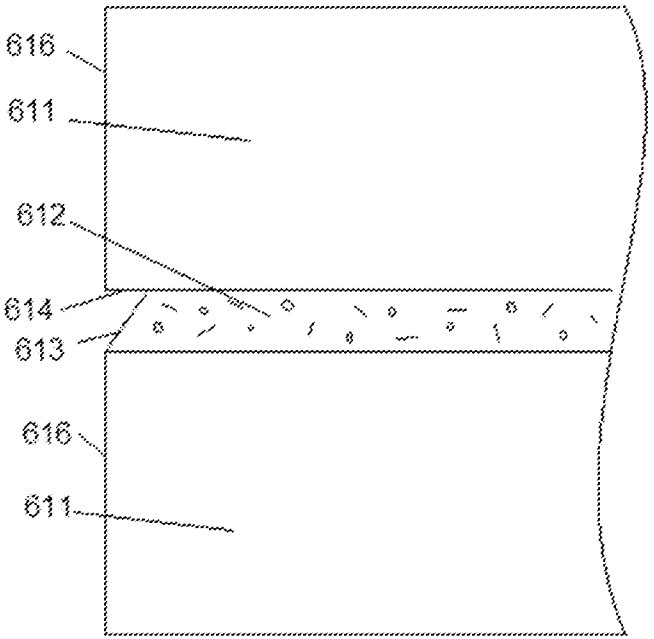
FIG. 6 is a cross-sectional side view of typical masonry construction showing (a) raked joint, and (b) weather joint style mortar joints.
Figure 6:
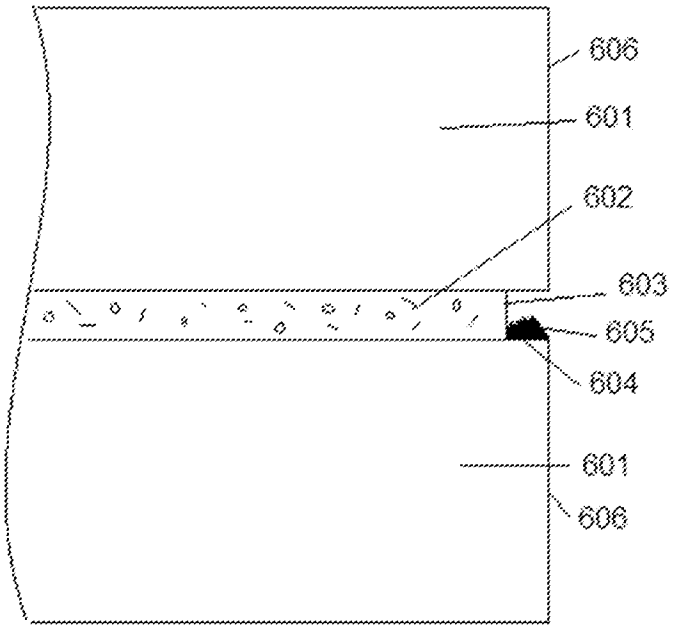

Development of a weather joint style masonry mortar joint was a critical development in improving the durability of masonry mortar joints, minimising water accumulation at and transport through, the junction between the mortar and the brick or stone. Referring now to FIGS. 6 (a) and 6 (b), FIG. 6 (a) provides a cross-sectional side view of a masonry section construction where masonry units 601 are connected by mortar joint 602. Front face 603 of mortar joint 602 is recessed from front face 606 of masonry units 601, leaving a substantially horizontal surface portion 604 on each masonry unit which can support the accumulation of dirt and debris 605. The improved weatherjoint masonry mortar joint is shown in FIG. 6 (b) where masonry units 611 are connected by mortar joint 612. Front face 613 of mortar joint 612 is level with front face 616 of the masonry unit immediately below it. It is recessed relative to front face 616 of the masonry unit immediately above it, thereby forming overhanging ledge portion 614.

The recessed masonry "weather joint" look in the cladding element of the invention replicates the aesthetic and self-cleaning benefits of a weather joint configuration. Recessed portion 107 provides a recessed mortar joint appearance and angled portion 108 provides a masonry weatherjoint aesthetic.

Referring again to FIG. 1 (a), recessed portion 107 also improves the aesthetics of the simulated masonry joint by more effectively reflecting light (particularly at low incident sun angles) from the angled joint surface. First face 101 of each cladding element 100 is highlighted by the more effective light reflection from the surface of the angled portion 108, compared to a "raked" style.

When installed and used in an exterior wall cladding section construction, the shadow zone provided by incident sun angle and the lower edge of overlap portion 109 of the cladding element installed immediately above it, will fall substantially within recessed portion 107, maximising the contrast between the shadow zone falling within recessed portion 107 and the light reflected by angled portion 108. In the embodiment shown in FIG. 1 (a), portion 109 overlaps profiled portion 106 by 25 mm. Recessed portion 107 is 35 mm wide and angled portion 108 is 7 mm wide. Once installed, the recessed mortar joint appearance substantially containing the shadow zone is provided by the difference between the width of recessed portion 107 and overlap or portion 109, which in this instance is 10 mm. The improved reflectance of incident sunlight by angled portion 108 maximises contrast between the two and provides an improved aesthetic in a constructed wall section.

First profiled edge portion 104 and second profiled edge portion 105 further include releasably engageable complementary profile portions for aiding ease of installation of adjacent cladding elements in a vertical array in a wall section construction. In embodiment shown in FIG. 1 (a), the releasably engageable complementary profile is a shiplap profile. In practice, section 110 of profiled portion 106 of a first cladding element releasably engages with overlap portion 109 of a second cladding element in the vertical array.

The shiplap profile further includes respective angled portions 103, 111, 112 on releasably engageable complementary profile portions 109, 110 for interlocking adjacent cladding elements in a vertical array. This configuration enables first profiled edge portion 104 of one cladding element 100 to accept and restrain second profiled edge portion 105 of an adjacent cladding element 100 in a vertical array. Each first profiled edge portion 104 of each cladding element 100 in a vertical array in a wall section construction, is fixed to a structural building substrate, such as a timber frame, by nailing through a nailing zone (not shown) located on recessed portion 106 such that, when an adjacent cladding element is installed in a vertical array, overlap portion 109 of the shiplap formation overlays nailing zone in recessed portion 106 and obscures the nailing locations from view.

Figure 2:
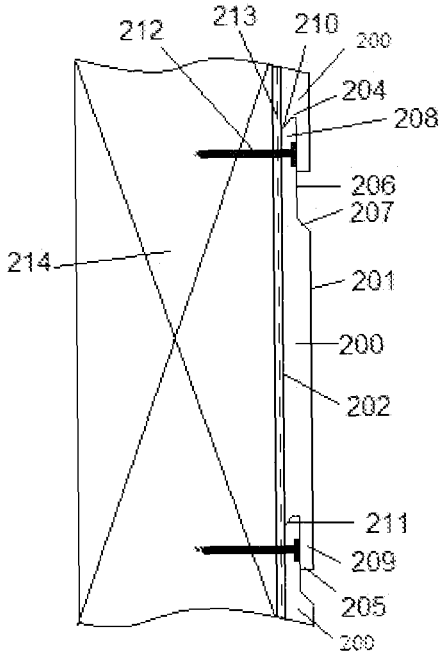
FIG. 2 is a cross-sectional side view of a cladding element according to the invention installed in a vertical array in a constructed wall section.

A portion of a vertical array of cladding elements in a wall section construction is best shown in cross-section in FIG. 2, where profiled edge portion 209 of one cladding element 200 has been installed by releasably engaging complementary interlocking portion 210 of releasably engageable complementary profile 208 with complementary interlocking portion 211 of releasably engageable complementary profile 209 on an adjacent cladding element. Cladding element 200 is then fixed in position by nailing into structural building substrate 214, in this case a timber frame. An optional weatherproofing layer 213 such as a building wrap may be installed over structural building substrate 214. Any suitable normal mechanical fixings, as generally known in the art, can be used as long as they meet local building code and cladding manufacturers' requirements. Nail 212 is obscured by shiplap overlap 209 of adjacent cladding element 200 in the portion of the vertical array shown.

When cladding elements are installed in a vertical wall section construction, as shown in FIG. 2, angle α of 45 degrees in this embodiment, provides an angle β (90 minus α) of 45 degrees, which is above the angle of repose for most particulate materials and results in minimisation or substantial elimination of accumulation of dust and debris on the profiled portion of a cladding element installed in a vertical array in a wall section construction. Any small amount of material that does collect is washed away even by small amounts of rain falling onto the wall surface and draining under the influence of gravity. Simultaneously, the angled portion 207 of recessed portion 206 of each cladding element 200, effectively reflects light differently to an observer thereby creating an effect similar to that provided in a masonry weather joint construction and improving the aesthetics of the installed wall section.

Figure 3:
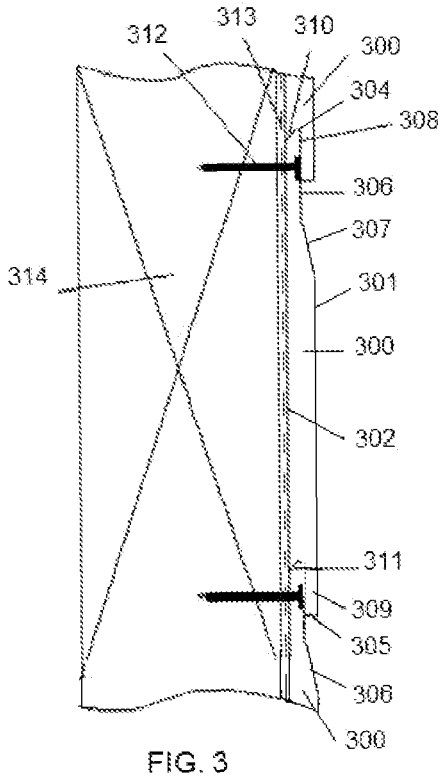
FIG. 3 is a cross-sectional side view of a second embodiment of the cladding element according to the invention installed on a vertical array in a constructed wall section.

An alternative configuration for a cladding element according to one embodiment of the invention is best shown in FIG. 3, where angle α is approximately 30 degrees, making an angle β of approximately 60 degrees. In this embodiment, angled portion 307 of cladding element 300 is effectively wider than that in the previous example having angle α of 45 degrees by virtue of the shallower angle α.

The combined aesthetic of light reflecting off the angled portion and shadow line, for the embodiment shown in FIG. 3, can be seen in FIGS. 4 (a) and 4 (b) for low incident sun angles and FIGS. 5 (a) and 5 (b) for high sun angles. Maximising the contrast between shadow zone 415 and the reflected light from angled portion 407 maximises the aesthetic effect FIG. 4 (a) shows a cross-sectional end view and (b) a corresponding front view of a constructed wall section comprising at least one cladding element 400, each fixed to structural timber subframe 414 via nails 412. Relatively low angle sun rays 416 strike cladding elements 400 creating shadow zone 415. The width of second profiled edge portion 405 in combination with incident sun angle 416 provides shadow zone 415 that will vary during the day as the sun angle changes in the sky, as well as with latitude.

In FIG. 5 (a) a cross-sectional side view and the corresponding front view in FIG. 5 (b) shows the effect of an increased shadow zone 515 provided by a high incident sun angle indicated by dotted lines 516.

A cladding element as described in any of the embodiments above is generally secured to the underlying structural wall structure by any suitable means, which will depend on the wall structure and cladding element materials. For example, when cladding elements are made from a nailable material (e.g. timber, fibre cement and the like) and the studs are a nailable material (e.g., timber or nailable metal), conventional nails are typically suitable for fixing said cladding elements. Nails that may be concealed, such as brad style nails, may be preferred when desired. Where the width of the recess allows, fixing is preferably along that recess adjacent the first profiled side edge. This step, while not essential, ensures that the fixing will be concealed by overlap from releasably engageable complementary profile portion 109 when the next cladding element is positioned on top and engaged with releasably engageable complementary profile portion 110. The spacing of the fixings along the length of the cladding element will generally be determined by stud spacing. Such spacing may vary and is typically that recommended by the desired manufacturer and/or by relevant building codes.

A method of forming a constructed wall section comprising cladding elements described above typically includes first providing a building sub-structure such as a building frame, and securing a plurality of cladding elements to the substructure in a predefined array. Cladding elements may be arranged in a typical staggered pattern array or may be arranged in one or more adjacent vertically aligned arrays where each side edge of each cladding element is aligned with a corresponding side edge of an adjacent cladding element.

In a representative example, as shown in FIG. 7, a perspective view is provided of a partially constructed wall section formed by first providing a wall sub-structure 714, for example by constructing a timber frame. In this example, the frame may include stud arrangements suited to supporting a variety of openings such as door and window openings, and the like and may include double 45 mm studs, double 35 mm studs separated by 15 mm packers and/or triple 35 mm stud, as required. Alternative configurations for suitable building substructures may be determined by local building practice and regulation.

When desired, a vapor permeable membrane 713 may be installed over the building sub-structure, allowing for a suitable overhang as recommended by the manufacturer. A datum line 720 is established to provide a reference line for installation of first cladding element 700; the datum will typically be used to align the bottom edge of the first cladding element; the datum line should be square to vertical flashing stops and square to the bottom edge of the first cladding element.

A sealant 719 may be applied inside fastener locations. A first cladding element is positioned to provide a suitable overhang in line with the manufacturers' recommendations, which is often around 20-50 mm. Fastening, in this case using nail fasteners 712, of the first cladding element to a building substructure 714 should be performed in accordance with manufacturer's recommendations and any applicable local building code requirements. Once first cladding element 700 has been installed, the second profiled edge portion 705 of a second cladding element is then releasably engaged with the first profiled edge portion 704 of the first cladding element. Similarly, the process can be repeated subsequently fitting a third cladding element and so on until all required cladding elements are fixed to the building substructure. Preferably, each cladding element is checked to ensure it is level and the height of each row of horizontally adjacent cladding elements is kept the same.

For traditional or staggered array wall section construction, cladding elements may be joined on and off stud without the use of a vertical flashing stop to create a traditional butt join. In some embodiments and to maximize strength and aesthetic features, butt joins may be staggered over two or more stud lines (e.g., joints in vertically adjacent rows of cladding elements are not located in the same vertical line).

When cladding elements are installed in one or more vertically aligned arrays, joining strips or vertical flashing strips 717, are used to weatherproof the joint and to provide an aesthetic effect, such as a recessed or expressed vertical joint effect.

At vertical joints, vertical flashing strips 717 may be used and fixed to studs by nails 717. The rear of each cladding element may then be adhered to a vertical flashing strip using a suitable joint sealant 719, when desired.

A wall section constructed using cladding elements described above may further comprise one or more trim elements for providing a weather-proof joint for at least one side edge of each section formed by the adjacent cladding element ends. In one form, the trim element comprises a thin strip of material (sometimes in the form of a sheet) having a central portion that extends between the aligned ends of two arrays of adjacent panels. The trim element may be designed to replicate a base of a recess that corresponds closely to the depth of the first recess formed in the first major face of each cladding element.

It will be appreciated that the illustrated cladding element comprises a recessed masonry weather joint aesthetic and provides an improved shadow zone contrast and minimises dirt, and debris accumulation on the profiled portion of each cladding element in a constructed wall section through providing a self-cleaning functionality. Although the invention has been described with reference to specific examples, it will be appreciated by those skilled in the art that the invention may be embodied in many other forms.

The invention claimed is:

1. A cladding system, suitable for use in a building envelope, comprising a plurality of cladding elements, each of said cladding elements comprises:

a first face, a second face and a peripheral edge member, the first face and second face being spaced apart to define an intermediate portion of predetermined thickness (t), the peripheral edge member extending around the intermediate portion;

the first face comprising a profiled portion adjacent at least a portion of the peripheral edge member;

the profiled portion of the first face comprising a recessed portion that is exposed thereby simulating a recessed mortar joint in between said cladding elements of a constructed wall; a fixing zone intermediate the recessed portion and the at least a portion of the peripheral edge member; and an angled portion intermediate the first face and recessed portion, whereby the angled portion comprises an acute angle relative to a first and a second axes, wherein the axes are defined by intersection between the first face and a plane that extends perpendicularly from the first face, wherein the angled portion extends outwardly from the recessed portion in a manner so as to facilitate dirt and debris sliding off the recessed portion.

2. The cladding system as claimed in claim 1 wherein the acute angle is between 20 to 75 degrees.

3. The cladding system as claimed in claim 2, wherein the acute angle is between 30 to 60 degrees.

4. The cladding system as claimed in claim 1, wherein the acute angle is approximately 45 degrees.

5. The cladding system as claimed in claim 1, wherein the recessed portion comprises a planar section that is substantially parallel to the plane of the first face.

6. The cladding system as claimed in claim 1, wherein the peripheral edge member comprises at least one profiled side edge.

7. The cladding system as claimed in claim 1, wherein the peripheral edge member comprises a first profiled edge portion and a second profiled edge portion, whereby each of the first and second profiled edge portions comprises a releasably engageable mutually complementary profile.

8. The cladding system as claimed in claim 7, wherein the releasably engageable complementary profile is an extended shiplap profile.

9. The cladding system as claimed in claim 7, wherein the releasably engageable complementary profile further includes an angled portion for releasably interlocking adjacent cladding elements in a vertical array.

10. The cladding system as claimed in claim 7, wherein the recessed portion includes a nailing zone.

11. The cladding system as claimed in claim 7, wherein the first face, second face and peripheral edge member are integrally formed as a single unit.

12. The cladding system as claimed in claim 7, wherein the cladding element is made from fibre cement.

* * * * *